United States Patent [19]

Brockhaus

[11] Patent Number: 4,679,242

[45] Date of Patent: Jul. 7, 1987

[54] CONVERTIBLE COOLER AND CUSHION

[76] Inventor: Peter B. Brockhaus, Rte. 1, Owen, Wis. 54460

[21] Appl. No.: 661,926

[22] Filed: Oct. 17, 1984

[51] Int. Cl.[4] ..... A45C 7/00; B65D 30/20; B65D 81/38; A47J 41/00

[52] U.S. Cl. ..... 383/4; 383/18; 383/86; 383/107; 383/110; 383/902; 190/1; 190/8; 190/107; 206/216; 206/522; 206/545; 229/41 R; 297/118

[58] Field of Search ..... 206/521, 522, 216, 545; 190/8, 107, 1, 103; 428/178; 229/41 R; 383/2, 18, 86, 107, 110, 4, 902; 5/455; 297/118

[56] References Cited

U.S. PATENT DOCUMENTS

| | | | |
|---|---|---|---|
| 179,745 | 7/1876 | Blake | 383/18 X |
| 589,208 | 8/1897 | Gareis | 229/41 R |
| 756,311 | 4/1904 | Adams | 229/41 R |
| 798,804 | 9/1905 | Kunz | 428/178 X |
| 909,248 | 1/1909 | Staeger | 383/2 X |
| 909,325 | 1/1909 | Patch | 190/107 |
| 1,040,300 | 10/1912 | Fitzgerald | 190/107 |
| 1,341,404 | 5/1920 | Wisniewska | 383/18 X |
| 1,636,838 | 7/1927 | Roser | 383/2 X |
| 2,289,254 | 7/1942 | Eagles | 383/110 X |
| 2,329,444 | 9/1943 | Snyder | 383/86 |
| 2,343,260 | 3/1944 | Leader et al. | 383/86 X |
| 2,515,316 | 7/1950 | Schjelderup | 383/18 X |
| 2,575,191 | 11/1951 | Seipp | 383/110 X |
| 3,011,173 | 12/1961 | Goetz | 383/18 X |
| 3,031,121 | 4/1962 | Chase | 229/41 R X |
| 3,083,890 | 4/1963 | Ignell | 229/41 R X |
| 3,099,384 | 7/1963 | Baxter | 383/107 X |
| 3,254,825 | 6/1966 | Nolen | 229/41 R X |
| 3,294,387 | 12/1966 | Chauannes | 428/178 X |
| 3,577,305 | 5/1971 | Hines et al. | 428/178 X |
| 3,589,594 | 6/1971 | Fischlein et al. | 383/18 |
| 3,763,972 | 10/1973 | Karzmar | 383/110 X |
| 3,813,017 | 5/1974 | Pimsleur | 224/901 X |
| 3,850,362 | 11/1974 | Stollberg et al. | 229/41 R |
| 3,868,056 | 2/1975 | Keren | 206/521 |
| 3,949,916 | 4/1976 | Yount | 224/901 X |
| 3,980,225 | 9/1976 | Kan | 383/107 X |
| 4,003,455 | 1/1977 | Cortese | 190/8 |
| 4,119,249 | 10/1978 | Hanson | 224/901 X |
| 4,185,673 | 1/1980 | Daniello | 383/110 X |
| 4,190,918 | 3/1980 | Harvell | 190/8 X |
| 4,211,091 | 7/1980 | Campbell | 383/110 X |
| 4,211,267 | 9/1980 | Skougaard | 383/110 X |
| 4,535,828 | 8/1985 | Brockhaus | 160/236 X |

FOREIGN PATENT DOCUMENTS

| | | | |
|---|---|---|---|
| 0085534 | 8/1983 | European Pat. Off. | 383/110 |
| 1451642 | 7/1966 | France | 383/18 |

*Primary Examiner*—William Price
*Assistant Examiner*—Sue A. Weaver
*Attorney, Agent, or Firm*—Fuller, Puerner & Hohenfeldt

[57] ABSTRACT

A variable volume insulated container is manufactured from a flexible cover and a laminated insulator. The laminate is constructed of at least one layer of air bubbles encapsulated between sheets of heat reflecting thin flexible material. The bubble layers provide excellent insulative qualities. The insulated container is designed to fold inwardly accordion style along the side and bottom panels, thereby collapsing into an insulative and comfortable cushion. The flexability of the insulated container permits it to be partially collapsed along the side panels to efficiently insulate a partial cargo. The insulator is appropriately notched so that the insulator does not bunch in the corners when in the collapsed mode. The invention includes an insulated container having side and bottom walls which fold outwardly to collapse into a flat seat, and the insulator thereof is notched to prevent bunching when the seat is unfolded to the container mode.

1 Claim, 19 Drawing Figures

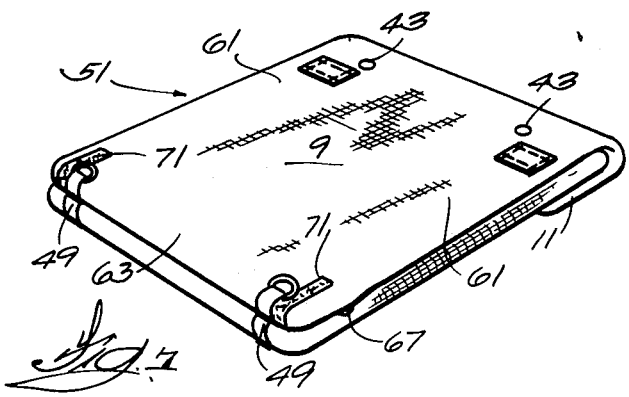
Fig. 7
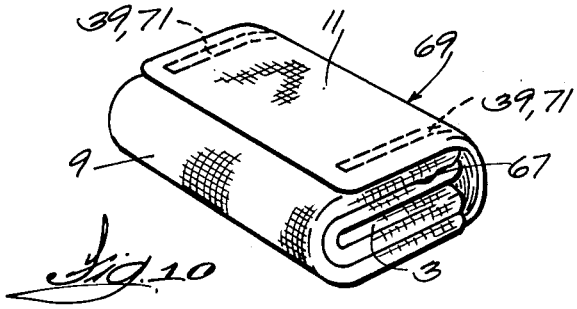
Fig. 10
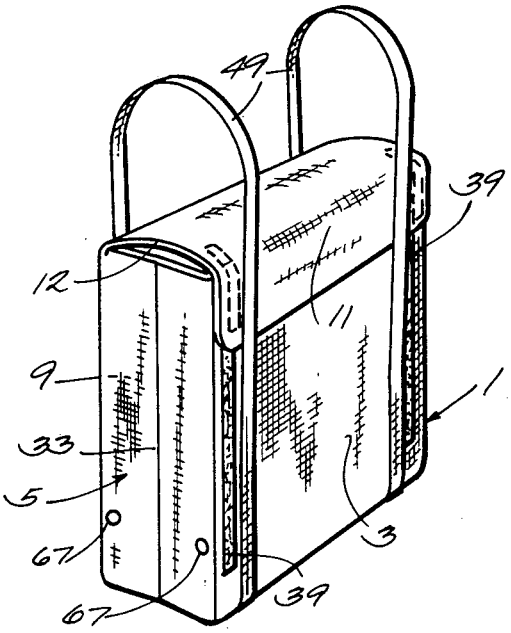
Fig. 6
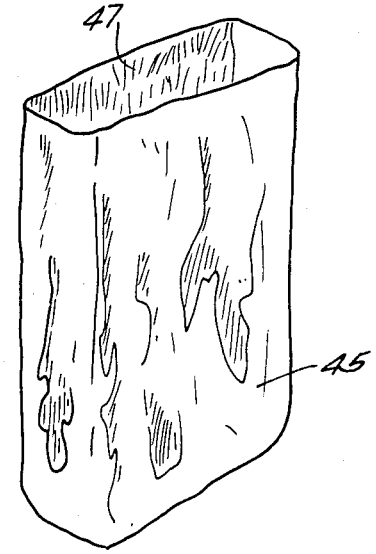
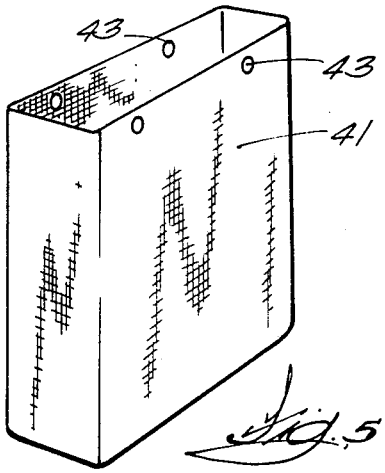
Fig. 5
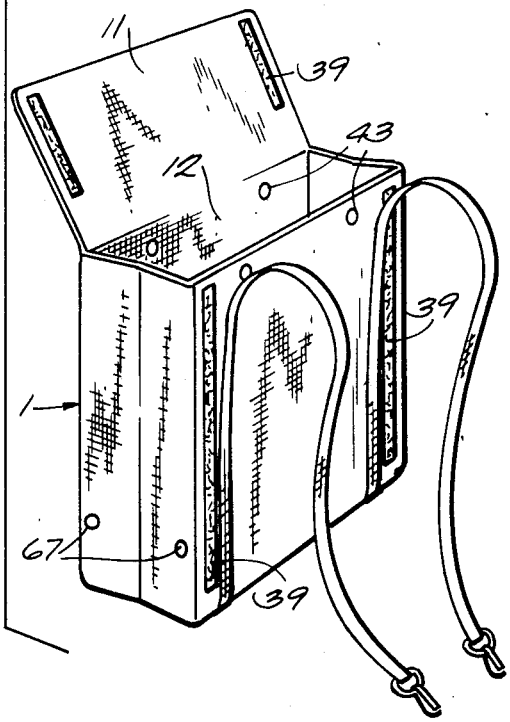

CONVERTIBLE COOLER AND CUSHION

BACKGROUND OF THE INVENTION

1. Field of the Invention

This invention pertains to containers, and more particularly to foldable insulated containers.

2. Description of the Prior Art

Personal foldable containers ranging from purses to backpacks are well known. The containers are made of flexible material for convenience and comfort, but conventional containers are usually limited to a single purpose. For example, they are not designed to be folded flat for use as a comfortable cushion or seat.

Also well known are insulated containers, which are of two general types. Insulated containers of the rigid type are frequently fabricated as foam filled metal or as less expensive styrofoam chests. The major disadvantage of rigid containers is that their volume cannot be varied with the amount of the contents; they are thus inefficient for insulating small cargos. Rigid type containers are single purpose; in particular, they are not intended to function as comfortable seats. Further, they inefficiently use space when stored.

Relatively flexible insulated containers are known, and, like the rigid type, they come in various sizes. Although conventional non-rigid containers are capable of being collapsed, they are nevertheless not easily adjustable to conform to the volume of partial cargos.

Some flexible containers are constructed so they have a memory; upon release from a fully or partially collapsed mode, they immediately spring back in an uncontrolled fashion to a full sized container. That characteristic renders storage inconvenient. Moreover, it effectively prevents utilizing the container for efficiently insulating partial loads as well as for other purposes, such as cushions.

Accordingly, a need exists for an insulated container which is capable of efficiently insulating partial loads and which is not limited functionally to insulating purposes.

SUMMARY OF THE INVENTION

In accordance with the present invention, a versatile insulated container is provided which is capable of efficiently insulating partial as well as full loads. That is accomplished by apparatus which includes a flexible insulator covered by a flexible cover and constructed so as to fold along predetermined fold lines to vary the volume of the container and to create different useful articles.

When completely unfolded, the present invention serves as a full size insulated container. When fully collapsed, the invention is useful as a comfortable cushion. When in the collapsed mode, the cushion may be further folded to create an elongated pocket, thereby rendering the invention useful as a hand warming muff. The insulated container may be partially collapsed and easily maintained in the partially collapsed configuration to reduce its volume and thereby efficiently insulate a partial load.

In the preferred embodiment, the insulator is formed as one or more layers of air bubbles encapsulated between thin sheets of moisture impervious flexible material. One of the sheets is embossed on one side with numerous indentations. A thin skin of a second flexible material is bonded to the side of the embossed sheets having the indentations, thus creating a layer of air bubbles. Two or more layers may be bonded together to form multi-layer insulators. The air bubble insulator has superior insulating qualities, and the air bubbles are comfortable to sit or stand on.

The insulator may be cut as a blank from a large roll in a pattern which, when suitably folded and the proper edges joined together, defines a fivepaneled open top container together with a top flap. The cover is suitably sewn to the insulator to make an attractive and durable product.

In the preferred construction, the side and bottom panels are formed as accordion type pleats. When the insulated container is fully opened, the side and bottom panels form generally flat surfaces, as do the front and back panels. To completely enclose the insulated container interior, the top flap folds over the open top and is suitably fastened in place.

The insulated container of the present invention is readily coverted into a comfortable cushion merely by collapsing the accordion pleats of the side and bottom panels. The pleats fold inwardly, so that the front and back panels maintain smooth exterior surfaces. The folded side and bottom panels form a double layer of insulation around three margins of the cushion. Thus, the cushion has a raised periphery on three sides to conform to the body much like a bucket seat. The top flap may be folded inside when the present invention is in the collapsed mode.

To eliminate bunching of the insulation in the corners when collapsing the insulated container, a triangular notch is removed from both ends of the bottom panel and from the side panels adjacent the bottom panel. The notches are preferably cut from the insulator blank prior to folding and sewing. When the two sides and bottom panels are pushed inwardly to fold them accordion style, the insulator forming the side and bottom panels fit within the notches of the bottom and side panels, respectively. Thus, the insulator of the sides and bottom panels do not overlap or restrict the folding. To assist the cushion in retaining its folded configuration, opposite sides of the front and back panels may be provided with cooperating snaps or a zipper.

The versatility of the insulated container is further increased by the addition of adjustable straps, thereby rendering the container carriable as a shoulder bag or as a back pack. Versatility is still further enhanced by use with a removable waterproof liner, which may be held loosely within the insulated container or releasably attached in place, as with snaps. To controllably vary the volume of the insulated container to conform to the contents thereof, the top portions of the side panels may be folded inwardly, and the cover flap may be folded directly over the front panel, thereby eliminating the volume at the top of the insulated container. To maintain the partly collapsed configuration, the top flap and front panel are provided with conventional releasable fastening devices.

Further in accordance with the present invention, the insulated container may be of a relatively small size suitable for carrying, for example, hot lunches. In the smaller size, the insulated container is preferably constructed so that the side and bottom panels fold outwardly when the container is folded to the collapsed mode to create a flat rectangular seat. When the rectangular seat is unfolded to the container mode, triangular tabs of material are created at the junctions of the side and bottom panels. To prevent bunching of the material in the triangular tabs, the insulator blank is cut so that insulation is removed from the tabs. The tabs are thus composed only of the flexible cover material, and they may be readily folded under the bottom panel of the insulated container and fastened together, as with snaps.

Other objects and advantages of the invention will become apparent to those skilled in the art from the disclosure.

BRIEF DESCRIPTION OF THE DRAWINGS

FIG. 5 is an exploded perspective view of the present invention;

FIG. 6 is a perspective view of the insulated container in the unfolded mode and equipped with carrying straps;

FIG. 7 is a perspective view of the present invention in the collapsed mode;

FIG. 18 is a top view of an insulator blank used in the insulated container of FIGS. 1–11; and FIG. 19 is a top view of an insulator blank used in the insulated container of FIGS. 12–17.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
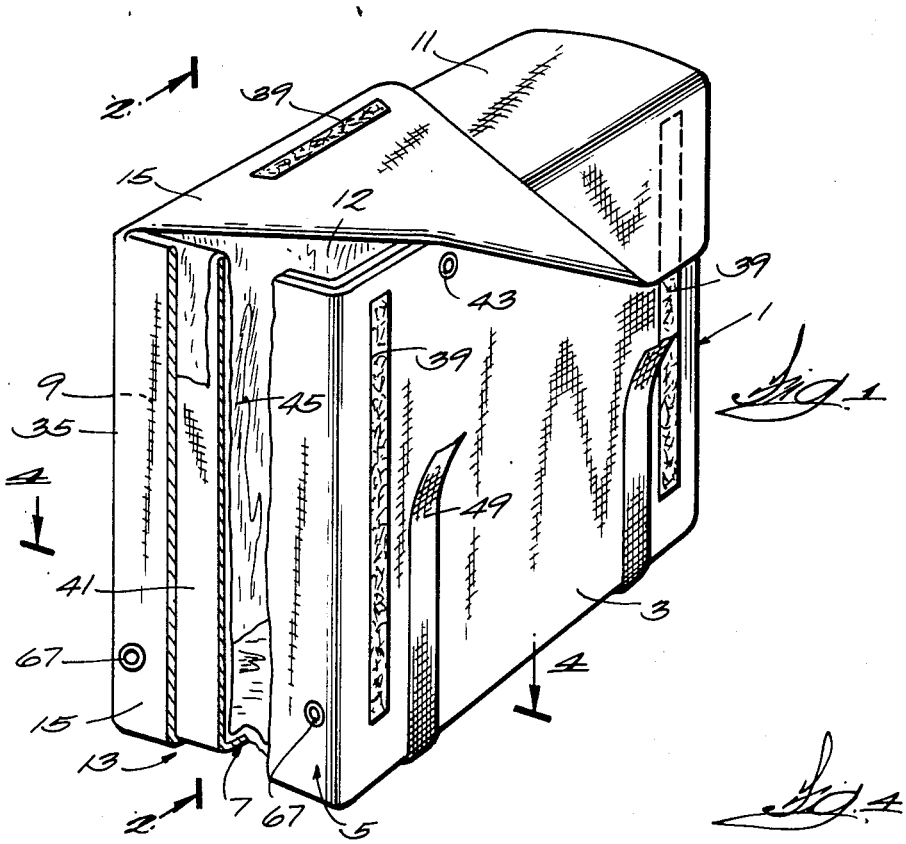
FIG. 1 is a partially broken perspective view of the insulated container of the present invention in the unfolded mode.

Referring to FIGS. 1 and 6, an insulated container 1 is illustrated which includes the present invention. The insulated container 1 is particularly useful for maintaining objects retained therein at a temperature other than ambient, but it will be understood that the invention is not limited to storage applications. Indeed, a feature of the invention is the ease with which it may be converted into other useful products.

The insulated container 1 includes a front panel 3, two substantially identical side panels 5, a bottom panel 7, a back panel 9, and a top flap 11 which is a continuation of back panel 9. The front, back, and side panels define a top opening 12.

The insulated container 1 may be of any desired size. A particularly useful size is about fourteen inches high and fourteen inches wide and four inches deep. That size will accommodate twenty-five 12-oz. beverage cans.

Figure 2:
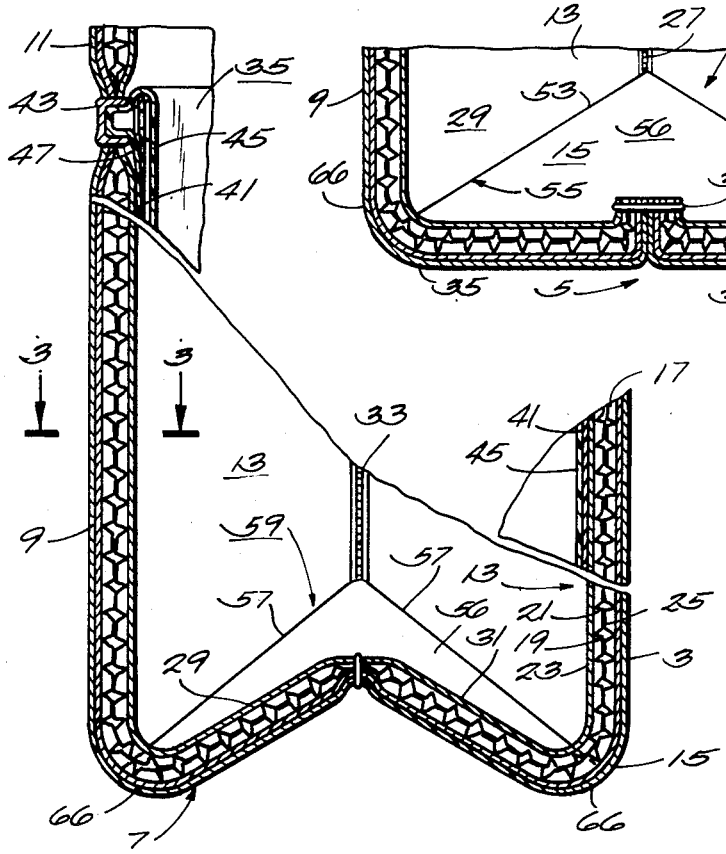
FIG. 2 is a cross-sectional view taken along lines 2—2 of FIG. 1, showing the bottom panel partially folded.
Figure 3:
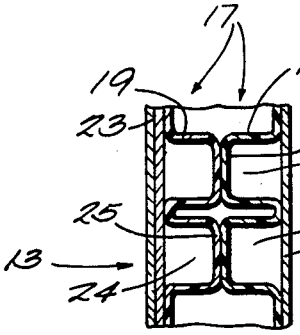
FIG. 3 is an enlarged sectional view taken along lines 3—3 of FIG. 2 showing the construction of the insulator.
Figure 12:
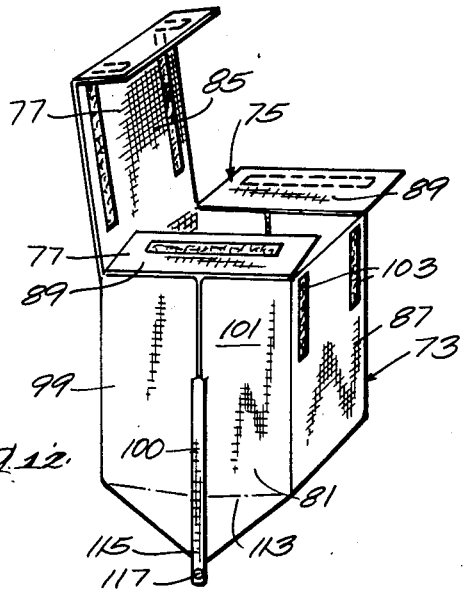

In the preferred embodiment, the insulated container 1 is manufactured as a flexible insulator 13 in combination with a flexible cover 15. Referring to FIGS. 2 and 3, the insulator 13 comprises at least one layer 17 of a moisture impervious heat reflecting laminate of air bubbles encapsulated between sheets of thin flexible material. Each layer 17 is fabricated by embossing a sheet 19 of thin flexible material with numerous indentations 21. The open sides of the indentations 21 are covered by a skin 23 of thin flexible material, which is bonded to sheet 19 to capture the air in the indentations in the form of numerous bubbles 24. Two or more layers 17 of bubbles may be bonded together to form a multiple layered insulator. Preferably, the two layers 17 are bonded along the respective crowns 25 of the indentations. The laminate described is similar in construction to that described in my copending U.S. patent application Ser. No. 490,466, U.S. Pat. No. 4,535,828. The sheet 19 may be of clear polyethylene, and the skin 23 may be of a reflective material such as metal foil or a metal coated synthetic material.

Numerous variations of the basic laminated layer 17 are possible. For example, a bubble layer may be created by bonding the open sides of two embossed thin sheets 19 to each other, and the crowns of two or more layers of that construction may be bonded together. The embossed sheet 19 may be of a reflective material, and the skin 23 may be of a clear material.

The insulated container 1 of the present invention has superior insulating qualities. The air trapped within the bubbles 24 prevent convection within the insulator 13. The air bubbles also provide high resistance to heat conduction. The reflective skin 23 reflects heat or cold both internally back to the stored items and externally to the atmosphere.

The cover 15 may be of any suitable material. A preferred material is a water repellant and easily cleanable fabric such as nylon. The cover is suitably joined to the insulator 13, as by sewing, on the exterior sides of the front, back, side, and bottom panels. The cover is sewn to both sides of top flap 11. The resulting structure is exceptionally strong in tension and can readily handle full capacity cargos. To retain the top flap in a closed position over opening 12, FIGS. 1 and 6, the top flap and the front panel 3 are provided with suitable fastening means, such as a pair of cooperating Velco fastening strips 39.

Figure 4:
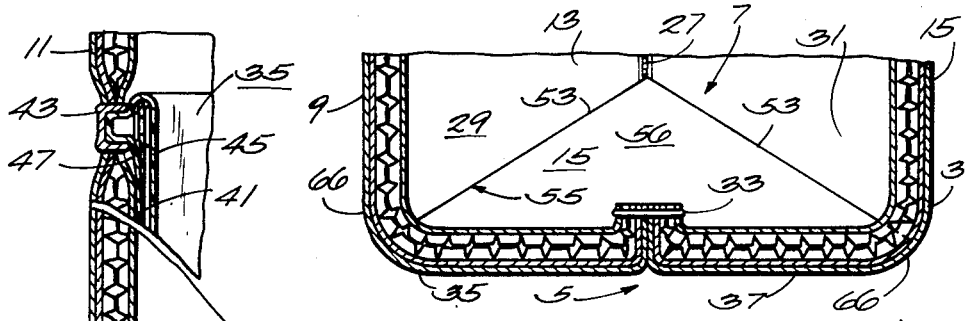
FIG. 4 is an enlarged cross-sectional view taken along lines 4—4 of FIG. 1, showing the insulated container of the present invention in the completely unfolded mode.

The insulator 13 and cover 15 are joined together, as by stitchings 27, longitudinally along the middle of bottom panel 7, FIGS. 2 and 4, thus dividing the bottom panel 7 into two substantially identical partial panels 29 and 31. The stitchings 27 facilitate the folding of the bottom panel, as will be explained in detail hereinafter.

As best illustrated in FIG. 4, the insulator 13 and cover 15 are joined longitudinally, as by stitchings 33, along the middle of both side panels 5. Thus, each side panel is divided into two substantially identical partial panels 35 and 37. The stitchings 33 are preferably on the interior of the insulated container 1 so as to enhance inward folding of the side panels, as will be explained.

In the illustrated construction, the insulated container 1 includes a sturdy liner 41, FIGS. 1, 2, and 5. The liner may be composed of a canvas material impregnated on the interior surface with a waterproof synthetic substance. The liner 41 is preferably removably attachable to the interior of the insulated container by cooperating conventional snaps 43 secured to the insulated container and liner. To further increase the versatility of the insulated container, a second liner of a conventional plastic bag 45 may be inserted inside liner 41. The top margins 47 of the bag 45 may be folded over and secured between the liner 41 and insulated container by snaps 43. As a further convenience in using the insulated container, adjustable length straps 49 of well known construction may be suitably secured thereto as by sewing. Thus, the insulated container is suitable for carrying as a back pack or an over-the-shoulder tote bag, FIG. 6.

Figure 8:
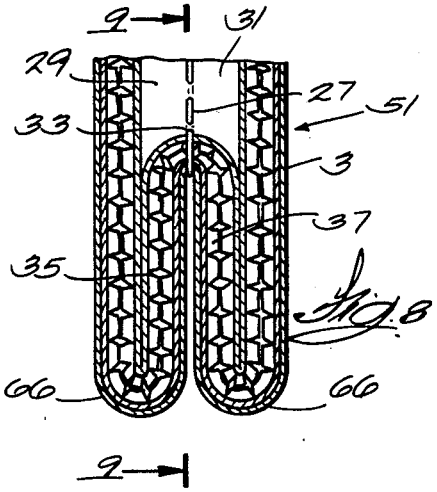
FIG. 8 is a cross-sectional view similar to FIG. 4, but showing the insulated container in the completely collapsed mode.

Further in accordance with the present invention, the insulated container 1 may be quickly and easily converted into other useful products. For example, the insulated container may be collapsed into a comfortable and easily carried cushion 51, FIG. 7. That is accomplished merely by folding the bottom and side panels 7 and 5 inwardly along stitchings 27 and 33, respectively. The stitchings 27 and 33 improve foldability, so that the bottom and side panels easily fold accordion style between the front and back panels 3 and 9, FIG. 8. It will be understood that the partial bottom panels 29 and 31 fold inwardly between the front and back panels in a similar manner.

To enable the insulated container 1 to be neatly but fully collapsed into the cushion 51, the insulator 13 is formed with V-shaped notches in the regions of the junctions of the side and bottom panels. As shown in FIG. 4, the insulator of the bottom panel 7 is cut along diagonal lines 53 to create a V-shaped notch 55. Accordingly, the insulated container comprises only a single layer 56 of the cover 15 at the ends of the bottom panel. Similarly, as shown in Fig. 2, the insulator of each side panel 5 is cut along lines 57 to create a V-shaped notch 59. Accordingly, the insulated container comprises only a layer 56 of cover material at the lower ends of the side panels. Fig. 18 illustrates the preferred configuration of an insulator blank 58 after it has been cut from a supply roll but before it is joined to the cover material and constructed into the completed product. During the collapsing process, the insulator at the ends of partial bottom panels 29 and 31 fold neatly into the side panel notches 59, FIGS. 2 and 9. Simultaneously, the insulator of the partial side panels 35 and 37 fold neatly into the notches 55 of the bottom panel 7, FIGS. 4 and 9. Consequently, bunching of insulator material at the corners is eliminated, and the insulated container folds into the cushion without bulky corners or the entire insulated container coming apart at the seams. The layer 56 of the cover folds inwardly easily at the corners and does not hinder foldability. With the corner construction of the present invention, multi-layered insulators of one inch thickness and more may be readily collapsed. To facilitate folding thicker insulators, the insulator may be scored through one or more layers 17 along the exterior sides of fold lines 66, FIGS. 2, 4, and 8.

To help maintain the collapsed configuration, conventional snaps 67, may be provided on associated partial panels 29, 31, 35, and 37, FIGS. 1, 5, 6, and 7. Snaps 43 may also be engaged if top flap 11 is outside of the front panel 3. Liner 41 may be left in or removed from the cushion at the user's option, but liner 41 must be removed in order to engage snaps 43.

Figure 9:
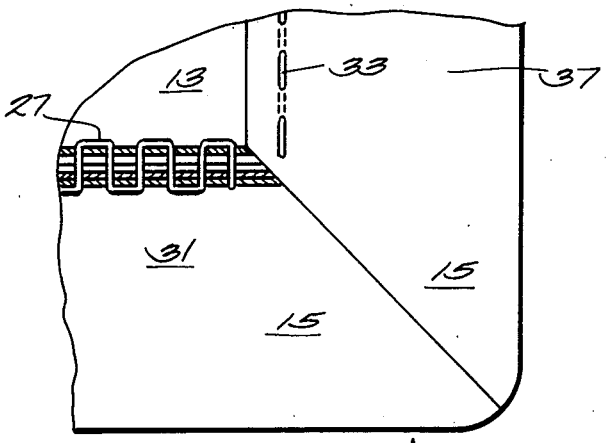
FIG. 9 is a cross-sectional view taken along lines 9—9 of FIG. 8.

The cushion 51 is exceptionally comfortable. Referring to FIGS. 7 and 9, the side partial panels 35 and 37 extend along the cushion margins 61 and the bottom partial panels 29 and 31 extend along margins 63. Thus, there are four thicknesses of insulator 13 along three margins of the cushion. Top flap 11 may be folded inside the cushion or it may be left outside and held in place by fasteners 39. In either situation, the cushion has a raised periphery which conforms to the user's body. The result is a comfortable bucketlike seat which is much preferred over a uniformly flat seat. The closed cell construction of the insulator enhances comfort because it does not permit air to squeeze out during use. Consequently, the user is always supported on a cushion of air and not on compressed solid cushion materials.

Figure 10:
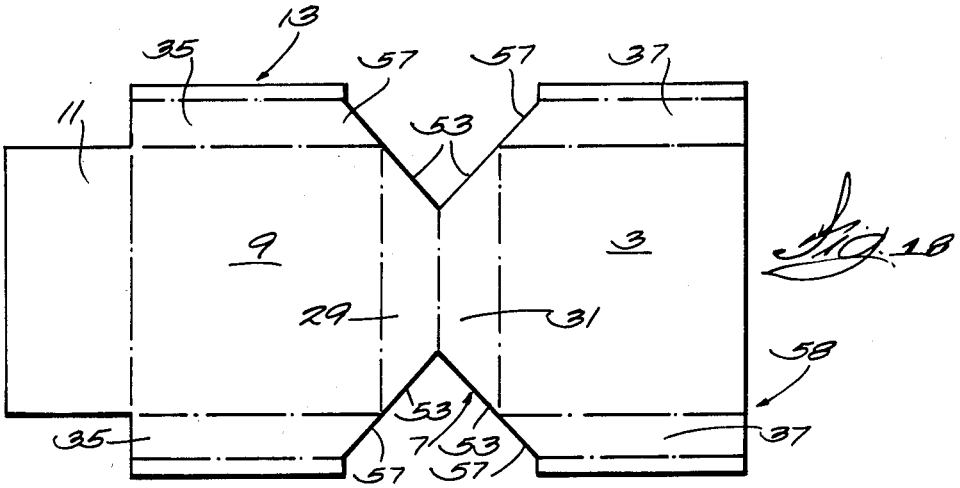
FIG. 10 is a perspective view of the cushion of FIG. 7 folded into a hand warming muff.

The cushion 51 may be converted into a hand warming muff 69 by folding front panel 3 over onto itself, FIG. 10. The top flap 11 is wrapped around the entire package. The Velcro strips 39 on the underside of the top flap, FIG. 5, are secured to cooperating Velcro strips 71 appropriately sewn near the bottom margin 63 of back panel 9, FIG. 7. The lightweight, flexability, and insulative properties of the insulator 13 render the cushion 51 ideal for use as a hand warmer.

Figure 11:
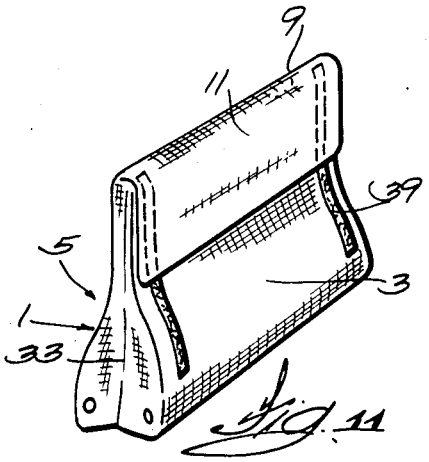
FIG. 11 is a perspective view of the insulated container of the present invention showing it partially collapsed to accommodate a partial cargo.

It is a feature of the present invention that the insulated container 1 may be collapsed to intermediate volumes between the fully unfolded insulated container 1 and the fully collapsed cushion 51. Referring to FIG. 11, a partially filled insulated container is shown. The structure of the present invention permits a partial collapsing by inwardly folding the upper portions of side panels 5 along stitchings 33. The top flap 11 is folded directly onto front panel 3 so as to bring the front panel into contact with back panel 9, thereby eliminating the volume associated with opening 12. Substantially the entire top flap is then in contact with the front panel, and it is releasably secured to the front panel by the Velcro strips 39. It will be appreciated that the carrying straps 49 as illustrated in FIG. 6 may be applied to the partially collapsed configuration of FIG. 11, thereby creating an easily carried adjustable volume tote bag.

Figure 12:
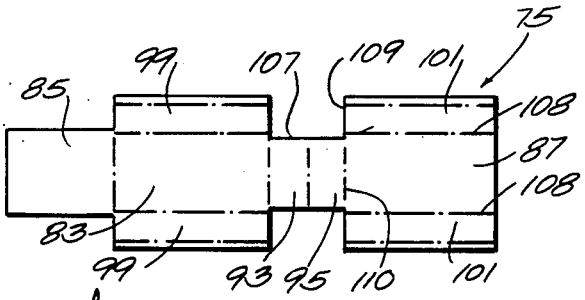
FIG. 12 is a partially broken perspective view of a partially unfolded modified insulated container.
Figure 13:
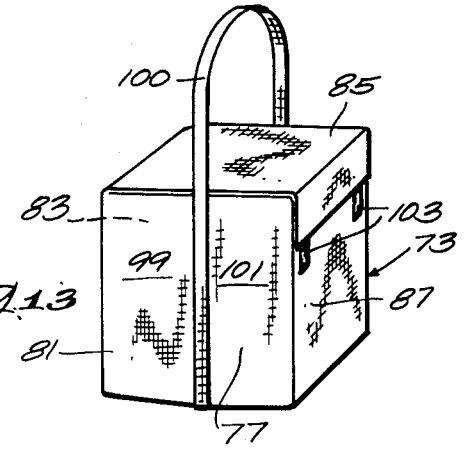
FIG. 13 is a perspective view of the insulated container of FIG. 12 but shown fully unfolded.
Figure 14:
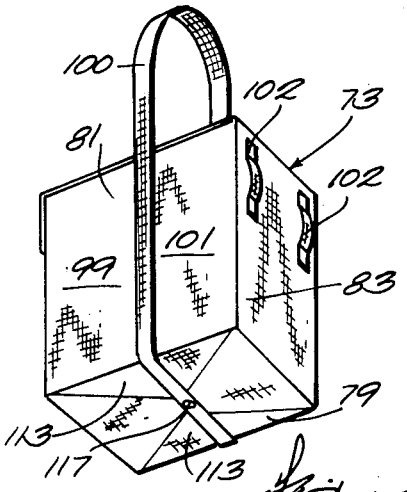
FIG. 14 is a perspective view of the fully unfolded insulated container of FIG. 13 as viewed from a different angle.
Figure 17:
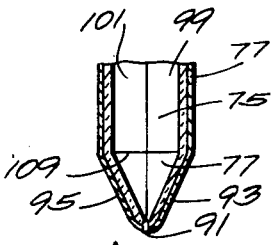
FIG. 17 is a cross-sectional view taken along lines 17—17 of FIG. 16.

The present invention is also embodied in the structure illustrated in FIGS. 12–17. Referring to FIGS. 12–14, a modified insulated container 73 is illustrated which is fabricated as a flexible insulator 75 covered by a flexible covering 77 in a manner generally similar to the construction of insulated container 1. Insulated container 73 thus possesses the strength and superior insulating qualities of insulated container 1.

In the fully unfolded mode of FIGS. 13 and 14, the insulated container 73 includes a bottom panel 79, substantially identical side panels 81, back panel 83, top flap 85, and front panel 87. The insulated container 73 further includes a pair of inside flaps 89 which are sewn to the insides of the side panels 81 along the top margins thereof, FIG. 12.

The insulator of the front, side, back, and bottom panels is covered with fabric 77 on the exterior faces thereof. The top flap is covered on both faces. Each inside flap 89 is covered with fabric on the face which contacts the interior face of the top flap 85 when the top flap is closed, FIGS. 12 and 13. In the fully unfolded mode, the insulated container may be of sufficient size to hold six 12-oz. beverage cans. That size also makes the insulated container ideal for carrying and storing hot lunches.

The insulator 75 and cover 77 are joined together, as by stitchings 91, longitudinally along the centerline of bottom panel 79, thus dividing the bottom panel into two partial panels 93 and 95. The stitchings 91 facilitate the folding of the insulated container as will be explained hereinafter.

Figure 16:
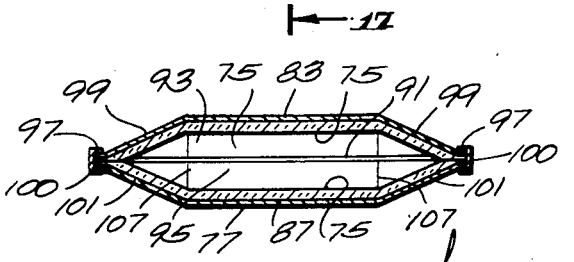
FIG. 16 is a cross-sectional view taken along lines 16—16 of FIG. 15.

As best shown in FIGS. 12 and 16, insulator 75 and cover 77 are joined along the middle of both side panels 81 by stitchings 97. Thus each side panel is divided into two substantially identical partial panels 99 and 101. The stitchings 97 are preferably on the exterior of the insulated container 73 so as to enhance outward folding of the side panels, as will be explained. The external seams created by side panel stitchings 97 are covered with a narrow elongated strip 100 of fabric which is fastened over the seam by the stitchings 97. The strip 100 is looped over the top of the insulated container to form a convenient carrying handle. As a further carrying convenience, a pair of belt loops 102 are secured to the back panel 83, FIG. 14.

To retain the top flap 85 in a closed position, FIG. 13, cooperating strips of Velcro fastener 103 may be appropriately secured to the top flap, front panel 87, and inside flaps 89, FIG. 12.

Figure 15:
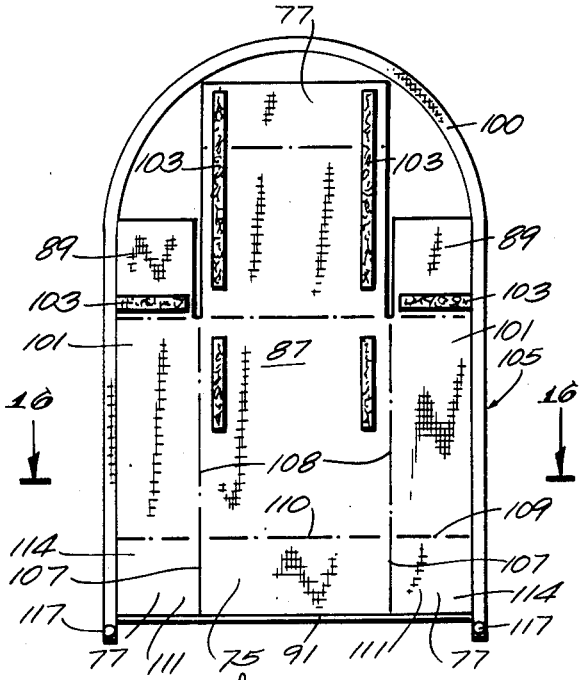
FIG. 15 is a partially broken front view of the insulated container of FIGS. 12–14 but showing the insulated container in the completely collapsed mode.

Pursuant to the invention, the insulated container 73 may be fully collapsed to create a convenient and comfortable seat 105, FIG. 15. As described previously, the bubble insulator 75 provides the user with excellent insulative and comfort characteristics when sitting or standing on cold or wet objects. In the collapsed mode, the side panels 81 fold outwardly along stitchings 97, and the bottom panel 79 folds outwardly along stitchings 91, FIGS. 16 and 17. Thus, a substantially flat seat is created, which, for a six-pack sized container, is about ten inches square.

It will be recognized that when the seat 105 is unfolded to create the insulated container 73, triangular tabs 113 are inherently created as part of the unfolding process at the junction of the side and bottom panels, FIG. 12. To prevent bunching of insulator 75 in the tabs 113, the insulator is formed with notches 114 which appear as rectangles when viewed in the collapsed configuration of FIG. 15. In particular, the insulator is cut along lines 107 which correspond to the fold lines 108 between the front and side panels, and along lines 109, which correspond to the fold lines 110 between the respective front and back panels and the bottom panel. FIG. 19 shows the configuration of the insulator blank after it has been cut from a supply roll but before it is joined to the cover material and constructed into the completed product. As a result of the cuts along lines 109 and 107, the seat corners 111 are devoid of insulation, FIG. 15. That permits the seat to be unfolded into the insulated container 73 and to have full insulation on all the interior faces of the panels while permitting flexability in the triangular tabs. As part of the unfolding process, the triangular tabs are neatly folded and held in place under the bottom panel 79. For that purpose, the ends 115 of strip 100 extend slightly beyond the margin of the seat, and cooperating conventional snaps 117 are secured to the ends 115, Figs. 12 and 14.

Thus, it is apparent that there has been provided, in accordance with the invention, a convertible insulated container and cushion which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A variable volume insulated container for insulating items from ambient temperatures comprising:

a. an insulator fabricated into a back panel, a front panel, two side panels, a bottom panel, and a top flap, the back, front, and side panels defining an opening to the interior of the container, the insulator including at least one sheet of thin flexible material embossed on one side with a multiplicity of indentations, each indentation having an open side and a crown side, and a skin of thin flexible reflecting metallic foil bonded to the embossed sheet on the open side of the indentations to encapsulate the air therein to create a layer of encapsulated air bubbles;

b. a cover of flexible material joined to the exterior faces of the panels and the top flap;

c. an inside flap joined to each side panel adjacent the container opening, the inside flap being covered with flexible material on the external face thereof; and d. means for releasably retaining the inside flaps in contact with the top flap when the top flap is in the closed position, and wherein the cover and insulator are joined along the longitudinal center line of each side and bottom panel to create a pair of partial panels symmetrical about each respective center line, and the side and bottom panels are foldable outwardly along the respective center lines thereof to thereby render the container fully collapsible into a substantially flat seat, and wherein the insulator is cut from a blank having the bottom panel interposed between and joined to the back panel and the front panel along respective fold lines between the bottom panel and the back and front panels, the blank back and front panels each being interposed between and joined to a side panel partial panel and having the longitudinal edges thereof coincident with the respective center lines of the side panels, the lower end of each partial side panel being colinear with the fold line between the bottom panel and the respective back and front panels, so that when the seat is unfolded the insulated container thereby produced has full insulation on all interior faces thereof and means forming triangular tabs in the cover material during the unfolding process at the junction of the bottom and side panels, said tabs being devoid of insulation and are thereby flexible for each unfolding of the seat without bunching of insulation in the triangular tabs, and wherein the cover and insulator are joined along the longitudinal center lines of the bottom and side panels to enhance foldability, and wherein:

i. an elongated narrow piece of flexible material is joined to the side panels along the longitudinal center lines thereof and is looped over the container opening to create a carrying handle;

ii. the flexible narrow piece of material extends beyond the bottom panel of the container to form a pair of short ends; and iii. the short ends are provided with fastening means for releasably fastening the short ends to each other, so that the flexible triangular tabs inherently produced in the cover material during the process of unfolding the collapsed seat to create an insulated container may be folded and held together in place under the bottom panel thereof by the fastening means.

* * * * *